United States Patent [19]

Alessi

[11] Patent Number: 4,862,642

[45] Date of Patent: Sep. 5, 1989

[54] DECORATIVE FIXTURES

[76] Inventor: Francis Alessi, 1674 Charles St., North Merrick, N.Y. 11566

[21] Appl. No.: 209,106

[22] Filed: Jun. 20, 1988

[51] Int. Cl.[4] ..... E05B 1/00

[52] U.S. Cl. ..... 49/460; 16/110 R

[58] Field of Search ..... 49/460; 16/110 R, 126, 16/125, DIG. 24, DIG. 19, 112, 111 A

[56] References Cited

U.S. PATENT DOCUMENTS 2,931,078 4/1960 Beyrle ..... 49/460

3,115,720 12/1963 Lachance ..... 16/111 A X 3,514,904 6/1970 Riegelman ..... 49/460

*Primary Examiner*—Philip C. Kannan

*Attorney, Agent, or Firm*—Bauer & Schaffer

[57] ABSTRACT

A color enhancing device adapted for use on panels such as a cabinet or closet door which is a clear plastic hollow body into which a removable decorative strip is inserted. The panel to which the handle is attached is provided with slats through which the decorative strip may be removably inserted in the handle without removing the handle from the door panel.

15 Claims, 2 Drawing Sheets

Fig. 3
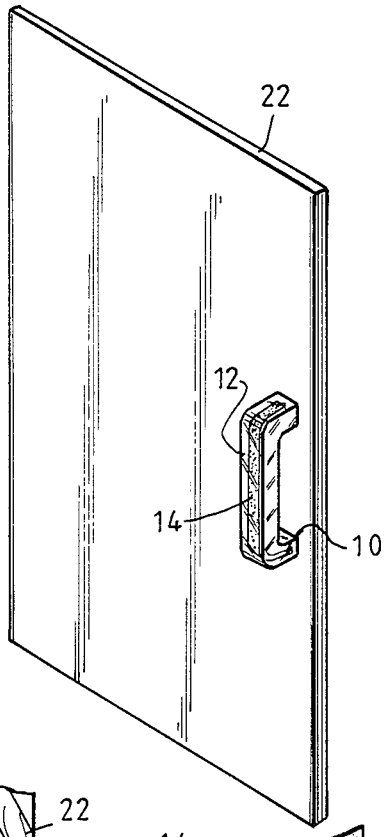
Fig. 2
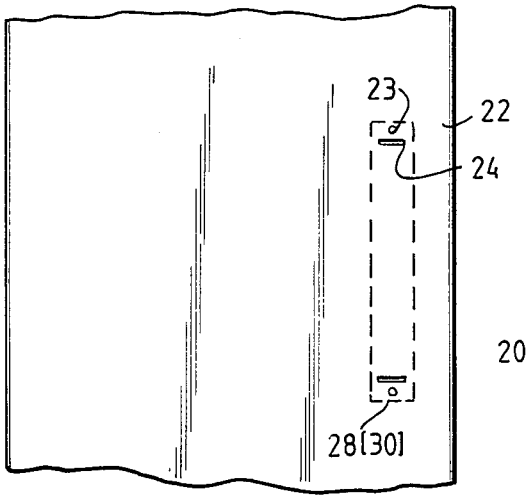
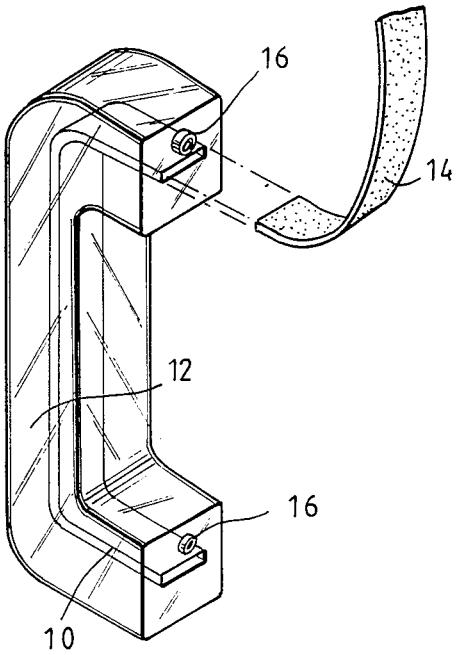
Fig. 1
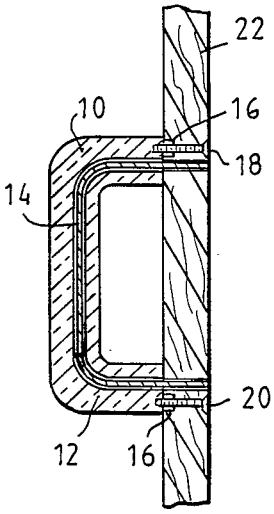
Fig. 4
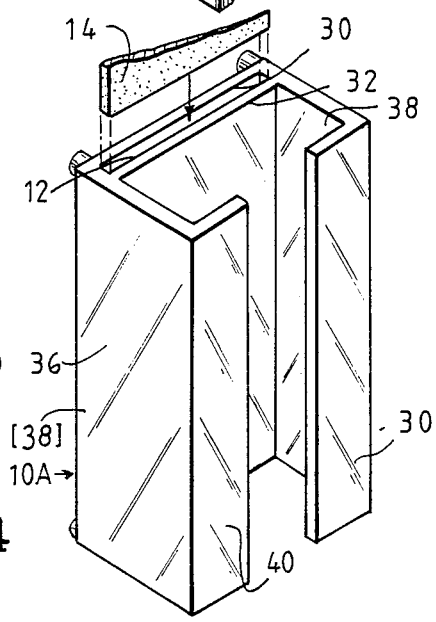
Fig. 5

DECORATIVE FIXTURES

The present invention relates to decorative fixtures for cabinets, doors and the like, and more particularly, to a color means adapted to enhance the appearance of a cabinet or closet door, and the like.

BACKGROUND OF THE INVENTION

The matching or blending of color schemes is most popular in interior decorating. This is particularly true in homes or offices where the aesthetics of color are heeded in order to enhance the environmental surroundings and provide an attractive appearance, as well as to impart pleasing psychological effects to people using the environmental surrounding in the home or office. In homes or offices where cabinets and closets are common items of utility, it is often desirable from an aesthetic viewpoint, to provide color schemes which blend together in a pleasing manner, the color of the appliances, walls and cabinets, including their hardware, such as door handles and door panels and the like, as well as the plumbing fixtures and sinks installed therein, so that an overall pleasing aesthetic effect is obtained.

Some problems, however, do exist, especially with respect to cabinet and closet door handles and panels and the like. Usually, these fixtures are metallic or plastic of predetermined and non-variable color. It is necessary to remove the door handles, and sometimes even the door panels, and replace them with more appropriate handles and panels suitably color coded to achieve the desired overall aesthetic effect in the particular environment desired. This necessitates additional work, as well as additional expense. There exists, therefore, a need for the ability to modify the color of cabinet and closet door fixtures and panels which can be achieved without removing and exchanging these items in order to provide a more appropriate color therefor. The present invention fulfills such a need.

BRIEF STATEMENT OF THE INVENTION

In accordance with the invention in its broadest aspect, there is provided door fixtures or panels comprising a clear plastic body having an internal slot extending from one end of the body to the other end thereof, having a removable decorative strip disposed within the slot and means for attaching the device to a cabinet or closet door so that the decorative strip is accessible, without thereafter removing the cabinet door or panel.

The clear plastic body may be in the form of a cabinet or closet door handle or, in a modification of the invention, it may be an extruded channel strip made of clear plastic material provided with a first pair of spaced walls on one side which form the internal slat, for reception of the removable decorative strip, a pair of spaced walls extruding at right angles from the first pair of spaced walls and a pair of spaced strips extending at right angles from the second mentioned pair of spaced walls.

THE DRAWINGS

In order to describe the invention more fully, reference is directed to the accompanying drawings which are to be taken in conjunction with the following detailed description thereof and in which drawings:

FIG. 1 is an elevational view in perspective of a cabinet or closet door handle according to the present invention, showing the clear plastic body with the internal slot and a removable decorative strip to be inserted in the slot;

FIG. 2 is a partial elevational view of a cabinet or closet door panel showing slots positioned thereon for cooperation with the openings in the ends of the internal slot of the handle illustrated in FIG. 1 and, as well, the openings therein for reception of the means on the handle for attaching the same to the panel;

FIG. 3 is an elevational view in perspective showing the handle of FIG. 1 attached to the panel of FIG. 2 with a removable decorative strip in the internal slot;

FIG. 4 is a partial end view in elevation and sections of the arrangement of FIG. 3 showing in detail, the handle attached to the panel;

FIG. 5 is an elevational view in perspective of an extruded channel strip according to the present invention illustrating the spaced walls of the extruded channel strip and showing partially a removable decorative strip for insertion in the internal slot;

Figure 7:
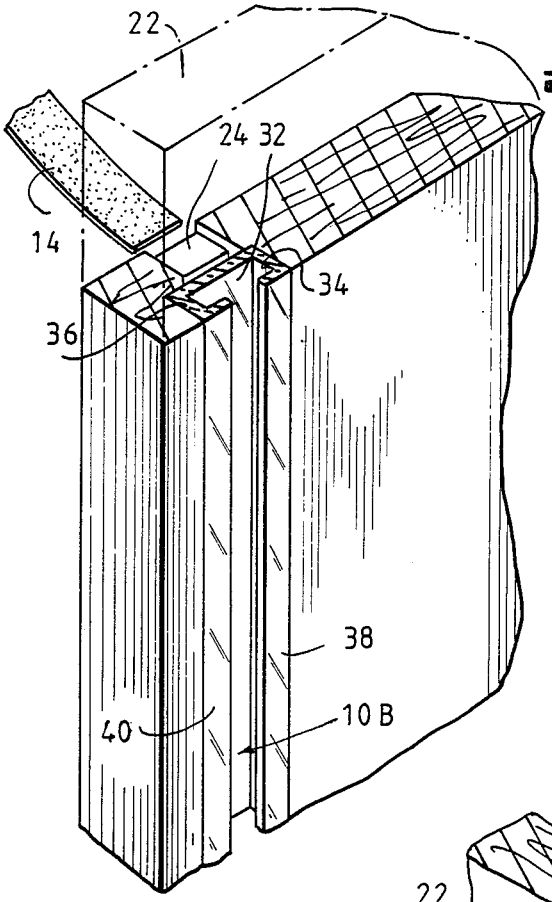
Figure 6:
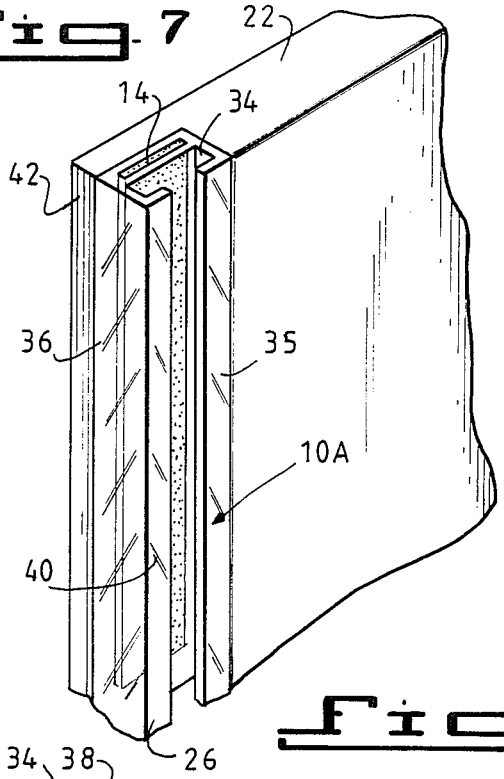
FIG. 6 is a partial elevational view in perspective showing a cabinet or closet door panel with the extruded channel strip of FIG. 2 set in place in a recess in the panel and the removable decorative strip in place in the internal slot of the channel strip.
Figure 8:
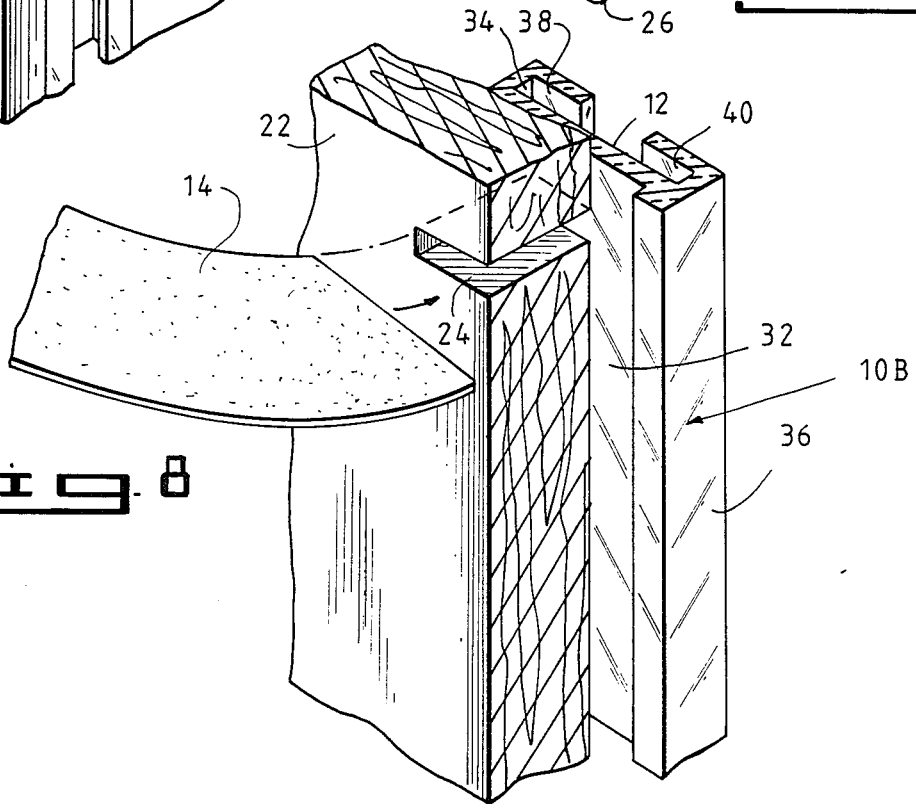

FIG. 7 is a partial elevational view in perspective of the arrangement shown in FIG. 6, except that the extruded channel strip extends in height to a point below the top of the panel and the panel is provided with a slot at the upper extent of the channel strip so that the removable decorative strip can be introduced therethrough for insertion into the internal slot of the channel strip; and FIG. 8 is a partial sectional view in elevation and perspective of the arrangement illustrated in FIG. 7 showing a modification of the extruded channel strip and in which modification on one wall of the extruded channel strip, forms part of the edge of the panel.

DESCRIPTION OF THE PREFERRED EMBODIMENTS

Referring now more particularly to FIG. 1, a clear plastic body 10 in the form of a door handle is provided with an internal slot 12 extending from one end to the other end of the body and which is open at both ends. A removable decorative strip 14 is inserted in slot 12 as shown in FIGS. 3 and 4. In addition, body 10 is provided with extensions 16 provided with appropriate internal threaded surfaces (not shown) for the fasteners such as screws 18 and 20 (FIG. 4). In order to attach the door handle to a door panel 22 (FIG. 3), the panel, as shown in FIG. 2), is provided with slots 24 and 26 which are located on the panel so that they register with the openings at each end of internal slot 12 and screw holes 28 and 30 which register with extensions 16 of body 10. Thus, screws 18 and 20 may be inserted in extension 16 and the handle attached to panel 22 so that at least one end of the slot is accessible so that the decorative strip 14, can be selectively inserted in or removed from internal slot 12 through slot 24 or slot 26 in panel 22 without removing the handle from the panel.

Turning now to FIG. 5, an extended channel strip generally depicted by reference numeral 10A is provided having a first pair of spaced walls 30 and 32 which form the internal slot 12. Another pair of spaced walls 34 and 36 extend at right angles from the first pair and a pair of spaced strips 38 and 40 extend at right angles from walls 34 and 36, respectively, to form the extruded channel strip. The removable decorative strip 14 is disposed in internal slot 12 through its open upper end. As may be seen in FIG. 6 the, extruded channel strip 10A may be made to be co-extensive in height with panel 22 and is disposed in a recess 42 cut into panel 22. On the other hand, the height of channel strip 10A may stop short of the top edge of panel 22 as shown in FIG. 7. When it is so constructed, panel 22 is provided with slot 24 to provide access for insertion and removal of decorative strip 14 in internal slot 12 without removing the channel strip from recess 42.

It is to be noted that in the modification of extruded channel strip 108 shown in FIGS. 7 and 8, wall 30 is not present and the internal slot 12 is formed by walls 32, 34 and 36 and strips 38 and 40. Moreover, in the embodiment shown in FIG. 6, wall 32 is not flush against the surface of panel 22 and the leading edge of panel 22 is undercut so that wall 36 forms a part of the leading edge of panel 22.

The removable decorative strip 12 employed in the present invention may be made from any of a wide variety of materials in suitable strip form. For example, it may be made from colored plastic material, aluminum or other metals or colored paper strips.

The color enhancing device of the present invention presents numerous advantages. For example, it may be made from readily available materials available in commercial channels and the various elements thereof may be constructed by known techniques in plastics technology. Moreover, the device permits variations in color schemes by permitting selective replacement of the color strip without the necessity of removing the door or closet handles or extruded channel strips from cabinet or closet door panels.

Numerous other advantages of the present invention will be readily apparent to those skilled in the art. It is to be understood, therefore, that the present invention is not to be limited to the described embodiments thereof, except as defined in the instant claims, since numerous variations of the present invention may be made without departing from the spirit and scope thereof.

What is claimed is:

1. A color enhancing device adapted for use on decorative panels such as cabinet doors or closet doors and the like, comprising a clear plastic integral body having a pair of opposed ends and defining at least one transparent wall portion, said body having a slot extending internally along said transparent wall portion from one end to the other end of said body, a removable decorative strip disposed within said slot, and means for attaching said body to said panel to maintain at least one end of said slot accessible for selective replacement of said strip, while said body remains attached to said panel.

2. A color enhancing device adapted for use on decorative panels such as cabinet doors or closet doors and the like, comprising a clear plastic body provided with an internal slot extending from one end to the other end of said body, a removable decorative strip disposed within said slot, and means for attaching said body to said panel to maintain at least one end of said slot accessible for selective replacement of said strip, wherein the clear plastic body is an extruded channel strip having a pair of spaced walls on one side which form the internal slot, a pair of spaced walls extending at right angles from said first pair of spaced walls and a pair of spaced strips extending at right angles from the second mentioned pair of spaced walls.

3. The color enhancing device according to claim 2, wherein the removable decorative strip is a colored plastic strip.

4. The color enhancing device according to claim 2, wherein the removable decorative strip is an aluminum strip.

5. The color enhancing device according to claim 2, wherein the removable decorative strip is a colored paper strip.

6. A color enhancing device adapted for use on a closet door comprising in combination (1) a door handle having a body of clear plastic and which is provided with an internal slot extending from one end to the other end of said body and which is open at both ends, and means for attaching said handle to a door panel disposed on said body; (2) a door panel having exterior and interior surfaces and provided with a pair of slots and a pair of openings, located on and passing through said door panel, said slots and said openings being located in said door panel to register with the open ends of the internal slot of said door handle and the means for attaching said door handle to said door panel; and (3) a removable decorative strip disposed within the slot of said door handle, said decorative strip being insertable and removable from said slot through the slots in said door panel without removing said door handle from said door panel.

7. The color enhancing device according to claim 6, wherein the removable decorative strip is a colored plastic strip.

8. The color enhancing device according to claim 6, wherein the removable decorative strip is an aluminum strip.

9. The color enhancing device according to claim 6, wherein the removable decorative strip is a colored paper strip.

10. A color enhancing device adapted for use on a cabinet or closet door comprising in combination (1) an extruded channel strip formed of a clear plastic and having a first pair of spaced walls on one side which form an internal slot extending from one end to the other end of said channel strip and which is open at both ends, a pair of spaced walls extending at right angles from said first pair of spaced walls and a pair of spaced strips extending at right angles from the second mentioned pair of spaced walls; (2) a door panel having exterior and interior surfaces, a recess formed in said front surfaces for reception of said extruded channel strip; and (3) a removable decorative strip, disposed within the slot of said extruded channel strip and being insertable and removable from said slot without removing said extruded channel strip from said door panel.

11. The color enhancing device according to claim 10, wherein the extruded channel strip is co-extensive with the height of the door panel.

12. The color enhancing device according to claim 10, wherein the extruded channel strip is less than the height of the door panel and said door panel is provided with a slot extending from the back of said door panel through to the upper end of said extruded channel strip for insertion and removal of the removable deorative strip into and from the slot of the extruded channel strip.

13. The color enhancing device according to claim 10, wherein the removable decorative strip is a colored plastic strip.

14. The color enhancing device according to claim 10, wherein the removable decorative strip is an aluminum strip.

15. The color enhancing device according to claim 10, wherein the removable decorative striip is a colored paper strip.

* * * * *